United States Patent [19]

Geominy

[11] 4,011,118

[45] Mar. 8, 1977

[54] METHOD OF MANUFACTURING A COAXIAL CABLE, AND COAXIAL CABLE MADE BY THIS METHOD

[75] Inventor: Louis Joseph Henri Geominy, Venlo, Netherlands

[73] Assignee: U.S. Philips Corporation, New York, N.Y.

[22] Filed: May 21, 1975

[21] Appl. No.: 579,321

[30] Foreign Application Priority Data

May 21, 1974 Netherlands ..... 74-06784

[52] U.S. Cl. ..... 156/51; 156/250; 156/257; 174/28; 174/113 AS; 264/145

[51] Int. Cl.[2] ..... H01B 13/06

[58] Field of Search ..... 174/23 R, 26 G, 28, 174/29, 111, 113 AS; 156/51, 52, 55, 257; 264/138, 139, 145; 186/280

[56] References Cited

UNITED STATES PATENTS

| | | | |
|---|---|---|---|
| 2,599,857 | 6/1952 | Mildner | 264/145 |
| 3,110,088 | 11/1963 | Blom | 264/145 X |
| 3,688,016 | 8/1972 | Spade | 174/28 X |
| 3,761,332 | 9/1973 | Jachimowicz | 156/55 |
| 3,864,509 | 2/1975 | Gommans | 174/28 |

FOREIGN PATENTS OR APPLICATIONS

| | | | |
|---|---|---|---|
| 1,547,268 | 11/1965 | Japan | 156/51 |

*Primary Examiner*—David A. Simmons
*Attorney, Agent, or Firm*—Frank R. Trifari

[57] ABSTRACT

A method of manufacturing a coaxial cable by a continuous process in which a cylindrical dielectric material is extruded about a central conductor, and parts of the dielectric are mechanically removed to form spaces at regular longitudinal intervals. An outer sheath is then applied, providing a low-loss cable having gas-filled spaces which are individually water-tight.

7 Claims, 9 Drawing Figures

METHOD OF MANUFACTURING A COAXIAL CABLE, AND COAXIAL CABLE MADE BY THIS METHOD

BACKGROUND OF THE INVENTION

1. Field of the Invention

The invention relates to a continuous method of manufacturing a coaxial cable whose dielectric consists at least partially of a gas, such as air, the cable having spacers around a central conducting wire and a sheathing which comprises a cylindrical outer conductor and an outer sheath made of a synthetic material; and more particularly to a method of manufacturing a coaxial cable in which the spacers are shaped and positioned so that water which has penetrated into the cable can only spread over a limited distance.

2. Description of the Prior Art.

In a known cable of this type the spacers are discs made of a dielectric material such as polyethylene, provided around the central conductor at equal distances, for example as by injection molding. The spacers may be surrounded by a cylindrical sheath of a dielectric material. A disadvantage of this method is that during formation of the discs, which generally are provided in batches, the central conductor is stationary so that the process cannot really be regarded as continuous. In addition there is risk of systematic dissimilarities being introduced during manufacture which cause reflections in the frequency range for which the cable is intended. Furthermore, in this method it is difficult to coat the central conductor with an insulating material.

In another method the central conductor is enclosed in a closely surrounding tube of a dielectric material which when still soft is locally inflated and subsequently compressed so that discs are produced. This method provides an advantage that leakage of water into the cable does not cause short-circuits between the central conductor and the outer conductor. However, this method requires very close control of the temperature in the parts of the injection molding machine which are directly involved in the shaping process. Moreover, these parts are comparatively complicated.

SUMMARY OF THE INVENTION

It is an object of the invention to provide a method of manufacturing a coaxial cable by which the disadvantages of the known methods and cable constructions are avoided. According to the invention this is achieved by continuously enclosing a wire of a conductive material by a concentric cylinder of a synthetic material by an extrusion process, and after cooling of the synthetic material mechanically removing parts of the cylinder at intervals equally spaced along the length of the cylinder so as to leave separating portions extending to the initial surface of the synthetic material, so that in the next step, in which a sheathing is provided in intimate contact with the remainder of the initial surface, gas-filled spaces are produced extending in the direction of length of the cable between the extending portions and not communicating with one another.

A feature of this invention is that it permits removing a substantial amount of the dielectric material while leaving the central conductor enveloped throughout its length by a layer of synthetic material. The sheathing may then comprise a first cylindrical sheath made of a synthetic material, a cylindrical outer conductor and an outer sheath made of a synthetic material. In this construction the first sheath serves as the support of the outer conductor while compartments filled with a gas, such as air, are obtained which are entirely bounded by synthetic material. With buried cables such a construction is advantageous, because perforation of the sheathing and any subsubsequent inflow of water into a hollow space cannot cause a short-circuit between the central conductor and the outer conductor.

Another advantage of the invention is that the relevant parts of the cylinder of synthetic material surrounding the central conductor may be removed in various ways. In one embodiment, removing members may be regularly reciprocated in a direction at right angles to the assembly comprising the central conductor and its cylindrical dielectric material, which is continuously fed forward in the longitudinal direction of length. Such removing members may, for example, be milling cutters.

BRIEF DESCRIPTION OF THE DRAWING

These and other aspect of the invention will now be described more fully, by way of example, with reference to the accompanying diagrammatic drawings, in which.

DESCRIPTION OF THE PREFERRED EMBODIMENTS

Figure 1:
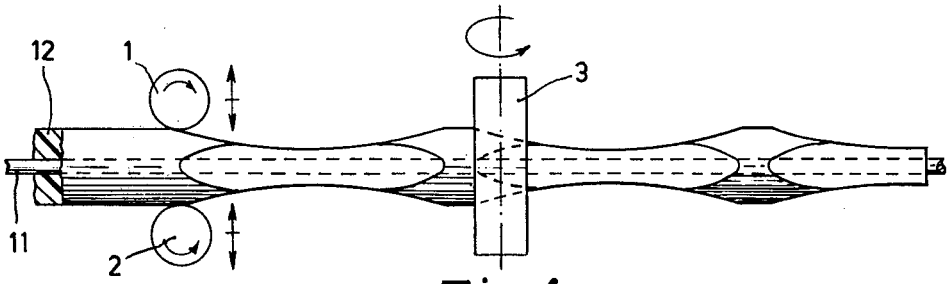
FIG. 1 shows schematically an arrangement for removing synthetic material by milling according to a preferred embodiment of the invention.
Figure 2:
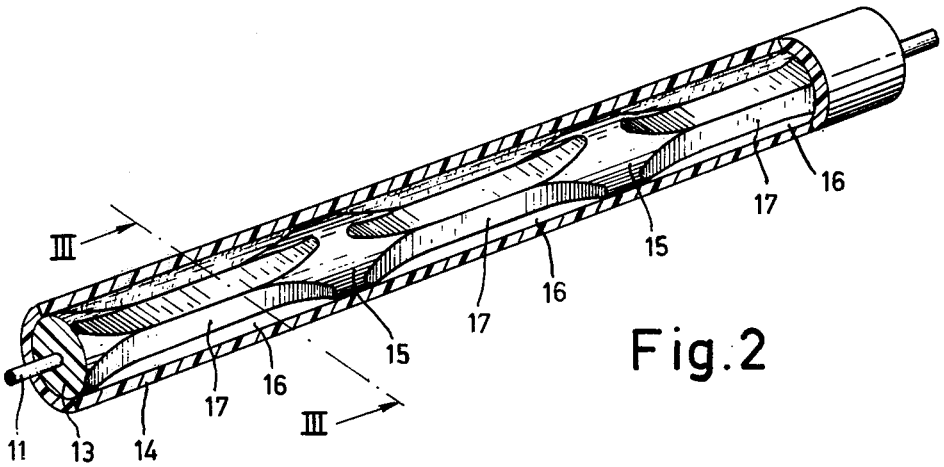
FIG. 2 is a perspective view, partially in section, of a central conductor provided with a spacer and a first sheath of synthetic material.
Figure 3:
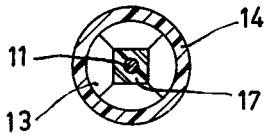
FIG. 3 is a cross-sectional view of the length of cable shown in FIG. 2 taken on the line III —III.

Referring now to FIG. 1, a copper central conductor 11 provided by extrusion with a closely surrounding cylinder 12 of polyethylene is fed forward, (to the right, as shown in the figure) at a constant speed between removing members, for example milling cutters 1 and 2. The removing members 1 and 2 are simultaneously moved alternately towards and away from one another, with a minimum separation such as to leave some synthetic material around the central conductor 11. In a next position synthetic material may be removed by means of two members which move in a direction at right angles to the direction of movement of the members 1 and 2, only that removing member 3 being shown which lies in front of the central conductor 11 and the surrounding cylinder 12 of synthetic material. This second set of removing members is also moved simultaneously, alternately towards and away from one another. In this manner a shape of a spacer 13 of synthetic material surrounding the central conductor 11 is obtained as is shown in FIGS. 2 and 3. The central conductor 11 and the spacer 13 are surrounded by a first sheath 14 made of polyethylene. Between parts 15 which have the initial outer diameter of the cylinder 12 of synthetic material (FIG. 1), which diameter is equal to the inner diameter of the sheath 14, discrete air-filled compartments 16 are formed.

FIG. 3 is a cross-sectional view taken on the line III-III of FIG. 2 at right angles to the direction of length of the central conductor 11, the reference numerals having the same meanings as in FIG. 2. These Figures show that the cross-section of the spacer 13 varies from circular to square. As shown in FIGS. 2 and 3, parts of the cylinder 12 of synthetic material have been removed so that the remainder of this cylinder comprises circularcylindrical portions 15 bounded by the peripheral surface of this cylinder and intermediate portions 17 bounded by four cylindrical faces which extend as pairs opposite one another, one on either side of the central conductor 11. The generatrices of each pair of faces extend parallel to one another while the generatrices of any two associated pairs extend at right angles to one another.

Figure 4:
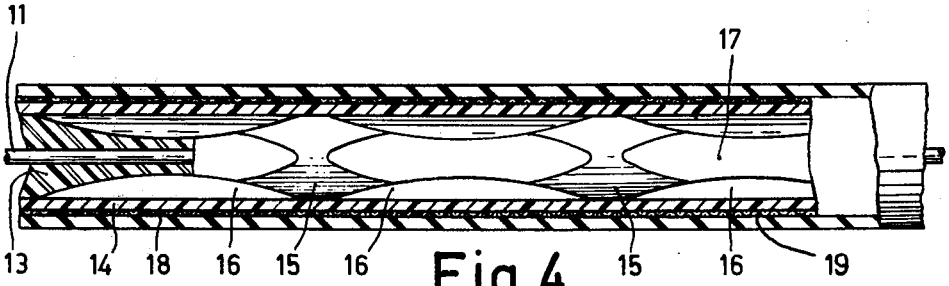
FIG. 4 is a side view, partially in section, of a cable provided with a spacer as shown in FIG. 2.

FIG. 4 shows partly in longitudinal section a cable provided with a sheath and a spacer 13 as shown in FIG. 2. Corresponding reference numerals have the same meanings as in FIG. 2. The cable has an outer conductor 18 which consists of a combination of a metal foil and a wire braid made of aluminum or copper, and an outer sheath 19 made of polyethylene.

Figure 5:
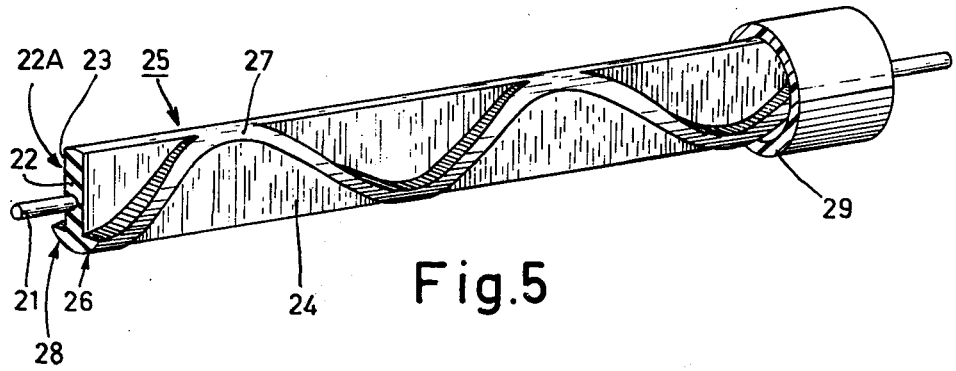
FIG. 5 is a perspective view, partially in section, of a spacer according to another preferred embodiment of the invention, FIG. 6 also is a perspective view, partially in section, of a conductor with spacer and first sheath, according to an embodiment which is a variation of the spacer shown in FIG. 5.

FIG. 5 shows another preferred embodiment of the invention. This spacer shape is obtained, for example, by using two pairs of milling cutters, the cutters of each pair being aligned while the spacing between the cutter ends is equal to the thickness of a central portion 22 and the axes of the pairs extend parallel to one another and at right angles to the axis of the cable. The shape of the spacer 22A shown is obtained by feeding the cable at a constant speed between the milling cutters and reciprocating the cutters at a constant speed. The central conductor is provided initially with a concentric cylinder of a synthetic material as in the embodiment discussed above. The spacer 22A consists of a center portion 22, bounded by faces 23 and 24 which lie on either side of the central conductor 21 and parallel thereto and by portions 25 and 26 of the outer circumference of the initial cylinder of synthetic material and by two longitudinally meandering portions 27 and 28 while lie one on either side of the central portion 22. The portions 27 and 28 may be offset with respect to one another or may be aligned with each other. They extend at right angles to the part 22, are joined thereto and bounded in the radial direction by portions of the outer circumference of the initial cylinder of synthetic material, and adjoin the inner surface of a sheath 29 which is to be provided in the next step of the method. Cooperation of the central portion 22, the meandering portions 27 and 28 and the sheath 29, which all consists of, for example, polyethylene, produces airfilled compartments in the cable which do not communicate with one another. The profile of the spacer 22A can be modified at will be varying the speed at which the cable is fed forward and the extent of the reciprocating movement of the milling cutters. If the axes of the milling cutters of one pair are mutually offset in the longitudinal direction of the cable, a form of the spacer 22A is obtained in which the meandering portions 27 and 28 are mutually offset.

Figure 6:
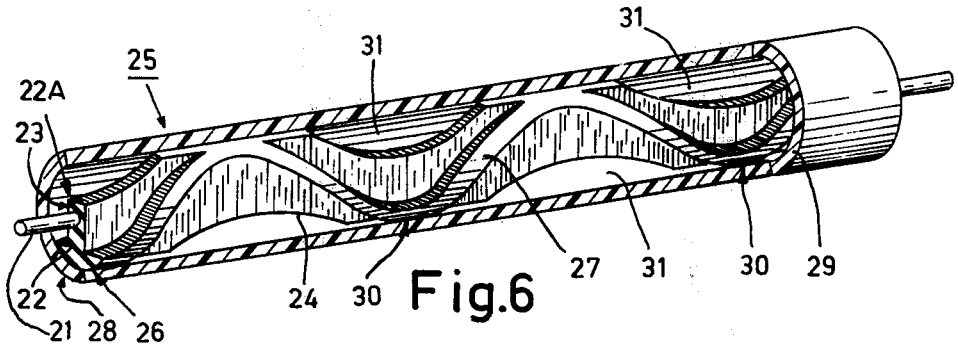

The reference numerals in FIG. 6 have the same meanings as in FIG. 5. FIG. 6 shows how further amounts of synthetic material can be removed from the spacer 22A, comprising a central portion part 22 and two meandering portions 27 and 28 which extend parallel to one another on either side of the central portion 22. Recesses 31 are formed in the central portion 22 between each pair of adjacent peaks situated on the same side of the central portion 22, such as the peaks 30 of the meandering portions 27 and 28, the depth of such a recess being less than the wall thickness of the initial cylinder of synthetic material so that the central conductor remains enclosed in synthetic material.

Figure 7:
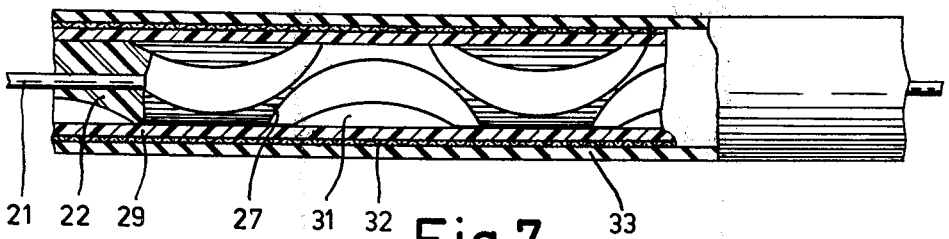
FIG. 7 is a side view, partially in section, of a cable provided with the spacer shown in FIG. 6.

FIG. 7 shows, partly in longitudinal sectional view, a coaxial cable having a spacer as shown in FIG. 6. Corresponding reference numerals have the same meanings as in FIG. 6. The cable has an outer conductor 32 comprising a combination of a metal foil and metal braid and an outer sheath 33 made of a synthetic material, for example polyethylene.

Figure 8:
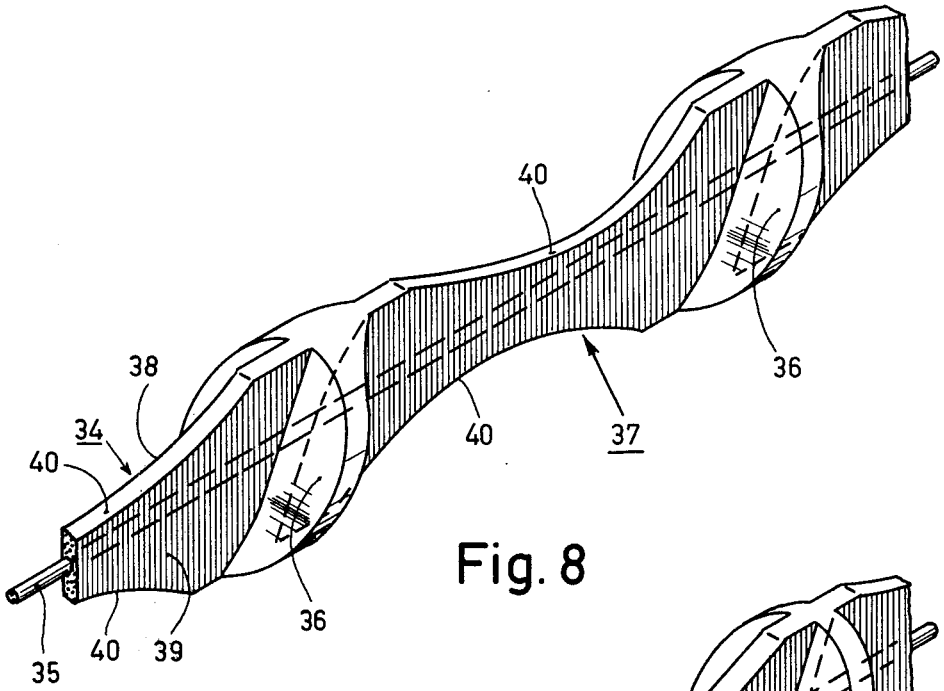
FIG. 8 is a perspective view of another embodiment of a spacer and a central conductor.

The spacer 34 shown in FIG. 8 is obtained, starting from the construction shown in FIGS. 6 and 7, by removing, by means of two additional milling cutters, some more synthetic material from the portions 27 and 28 (FIGS. 6 and 7) which meander in the direction of length of the cable. The additional milling cutters are arranged in parallel, one on either side of the cable, and are moved towards each other during transport of the cable, the minimum distance between the cutters being greater than the diameter of the central conductor 35 so that those edge parts are removed which in FIG. 6 slope downwards (in the direction from left to right). The ascending parts of the portions 27 and 28 (FIG. 6) are left so that disc-shaped bridge parts 36 (FIG. 8) are produced which extend parallel to one another at right angles to the central portion 37 and obliquely, i.e. at acute angles, to the central conductor 35. The central portion 37 of the spacer 34 shown in FIG. 8 corresponds to the central portion 22 shown in FIG. 6. The central portion 37 has two parallel faces 38 and 39 situated one on each side of the central conductor and is formed with recesses 40.

Figure 9:
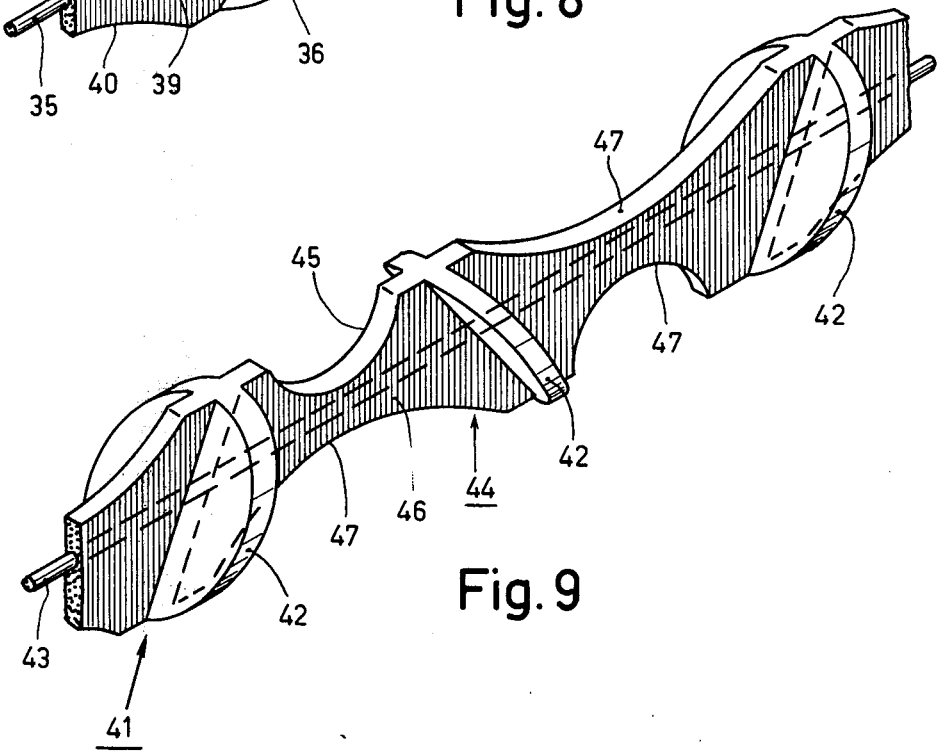
FIG. 9 is a perspective view of a further embodiment of a spacer and a central conductor.

FIG. 9 shows a still further embodiment of a spacer 41. This embodiment is obtained from a first stage of machining in which two pairs of milling cutters are used which are positioned in the same manner as described with reference to the construction of FIG. 5. The cutters have the same milling frequency as used in manufacturing the construction shown in FIG. 5, but they have a larger amplitude or deflection. This causes the continuity of the meandering portions, 27, 28 (FIG. 5) to be interrupted so that disc-shaped bridge parts 42 are obtained which extend at right angles to the central portion 44 and are at acute angles to the central conductor 40. By the use of two further milling cutters, recesses 47 are formed in the central portion 44, which has two faces 45 and 46 which extend parallel to the central conductor 43 on either side thereof, the depth of the recesses 47 being less than the wall thickness of the initial cylinder of synthetic material.

From the above, in particular from the description of the various embodiments, it will be seen that the possible variations with respect to the removal of material from the initial cylinder of synthetic material are substantially unlimited.

For example, there is a wide choice of the number of milling cutters used which may cooperate in pairs, of the positions of the cutters, of their rate of movement and of the speed at which the conductor and the cylinder of synthetic material are passed through the milling machine.

When removing material only a single restricting condition is to be taken into account, which is that between the removed parts bridge parts, hereinbefore also referred to as spacers (22A), are retained the outer dimensions of which correspond to the diameter of the initial cylinder of synthetic material. This ensures that the sheathing, which includes an outer sheath made of a synthetic material, can be slipped onto the synthetic-coated central conductor with a close fit so that the compartments which are produced by the removal of material and are filled with a gas, such as air, do not communicate with one another. Furthermore, the material of the cylinder of synthetic material preferably is not removed down to the central conductor in order to avoid short-circuits between the central conductor and the outer conductor in the event of leakage.

The extent to which, and the manner in which, material is removed by milling depends upon the requirements which the finished product (coaxial cable) has to satisfy in respect of, for example, rigidity, resistance to pressure and electrical properties.

Other possible arrangements according to the invention include a two-layer sheathing having an inner sheathing of metal foil folded into a cylinder surrounding the spacers, and acting as the outer conductor, and an outer sheath made of polyethylene or copolymers of polyethylene or other polyolefins.

An important advantage of the method according to the invention is that the desired properties of the finished product can readily be achieved by adjusting the spacer configuration.

The method according to the invention also provides the advantage, that in comparison with a cable having a solid dielectric, with equal attenuation a saving in material is obtained which is about 50% for the synthetic material and about 20% for the metal. Moreover, for the same attenuation, a cable according to the invention has a smaller diameter than a cable provided with a solid dielectric. This also results in a saving in material if the cable is to be armored.

This is illustrated by a cable as shown in FIGS. 2 to 4, which for a diameter of 8.5 mm has the same attenuation as a solid coaxial cable having a diameter of about 11.3 mm. A still further reduced cable diameter, for example a diameter of about 7 mm, while retaining the same attenuation is obtainable by removing some more synthetic material from the spacer shown in FIGS. 2 to 4. This may be effected, for example, by flattening diametrically opposed portions of bridge parts 15 (FIG. 2), the flattened faces of successive bridge parts being at right angles to one another, while at given intervals bridge parts 15 are not flattened in order to retain watertight compartments.

Another advantage is that a partially air-filled cable is obtainable by a continuous process, the cable having no troublesome reflections in the frequency range for which it is intended and being watertight along its direction of length.

What is claimed is:

1. A method of continuously manufacturing a coaxial cable having a dielectric which consists partly of a gas, comprising a central conducting wire, dielectric spacers surrounding said wire, and an envelope comprising a cylindrical outer conductor and an outer sheath, comprising the steps of continuously extruding a cylinder of synthetic dielectric material having a first diameter concentrically about a wire made of a conductive material, then cooling the synthetic material, then mechanically removing parts of the cylinder at longitudinally evenly distributed intervals along the cylinder by members which reciprocate with respect to the longitudinal direction of the cylinder of dielectric material such that said central conducting wire remains enveloped by directly adjacent dielectric material, while continuously advancing said cylinder in its longitudinal direction, the parts so removed being separated by circular cylindrical portions extending to said first diameter, and then applying a cylindrical sheathing about said dielectric so as to enclose gasfilled spaces, extending longitudinally along the cable without communication with one another, interiorly of said sheathing where the parts were removed.

2. A method as claimed in claim 1 wherein said sheathing comprises a first cylindrical sheath of a synthetic material, a cylindrical outer conductor and an outer sheath of synthetic material.

3. A method as claimed in claim 1 wherein said removing step comprises removing material so as to produce a longitudinal series of opposed pairs of concave cylindrical faces on opposite sides of the central conductor, a face being the boundary surface between a part removed and the remaining dielectric material, the generatrices of a first pair of faces being parallel to one another, the generatrices of a second associated pair of faces along the same longitudinal portion of the cable between two cylindrical portions being perpendicular to a plane parallel to the generatrices of the first pair.

4. A method of continuously manufacturing a coaxial cable having a dielectric which consists partly of a gas, comprising a central conducting wire, dielectric spacers surrounding said wire, and an envelope comprising a cylindrical outer conductor and an outer sheath, comprising the steps of continuously extruding a cylinder of synthetic dielectric material having a first diameter concentrically about a wire made of a conductive material, then cooling the synthetic material, then mechanically removing parts of the cylinder at longitudinally evenly distributed intervals along the cylinder such that said central conducting wire remains enveloped by directly adjacent dielectric material, the parts so removed being separated by portions extending to said first diameter, while continuously advancing said cylinder in its longitudinal direction, and then applying a cylindrical sheathing about said dielectric so as to enclose gas-filled spaces, extending longitudinally along the cable without communication with one another, interiorly of said sheating where the parts were removed; wherein said removing step comprises removing parts of the dielectric material to each side of a central portion, said central portion being bounded by two parallel faces lying on opposite sides of and parallel to the central conductor and by longitudinally meandering portions extending perpendicularly outward from said face to the surface of said cylinder having a first diameter.

5. A method as claimed in claim 4 wherein said meandering portions on opposite sides of said central portion are offset longitudinally with respect to one another.

6. A method as claimed in claim 4 wherein said removing step further comprises removing parts of said central portion between successive peaks of the meandering portions.

7. A coaxial cable manufactured by the method of claim 4.

* * * * *